US011583119B2

(12) United States Patent
Koizumi

(10) Patent No.: US 11,583,119 B2
(45) Date of Patent: Feb. 21, 2023

(54) DRINKING CONTAINER USED FOR TOASTING AND DRINKING CONTAINER SERVING AS BELL

(71) Applicant: KOIZUMI FACTORY, Takaoka (JP)

(72) Inventor: Toshihiro Koizumi, Takaoka (JP)

(73) Assignee: Koizumi Factory, Takaoka (JP)

( * ) Notice: Subject to any disclaimer, the term of this patent is extended or adjusted under 35 U.S.C. 154(b) by 967 days.

(21) Appl. No.: 16/396,094

(22) Filed: Apr. 26, 2019

(65) Prior Publication Data

US 2019/0254450 A1 Aug. 22, 2019

Related U.S. Application Data

(63) Continuation of application No. PCT/JP2017/039239, filed on Oct. 31, 2017.

(30) Foreign Application Priority Data

Nov. 1, 2016 (JP) ..... 2016-214635
Feb. 15, 2017 (JP) ..... 2017-025491

(51) Int. Cl.
*A47G 19/22* (2006.01)
*B65D 85/72* (2006.01)
(Continued)

(52) U.S. Cl.
CPC ..... *A47G 19/2227* (2013.01); *A47G 19/22* (2013.01); *B65D 85/72* (2013.01);
(Continued)

(58) Field of Classification Search
CPC ..... B65D 2525/289; B65D 2525/281; B65D 2525/28; B65D 23/10; B65D 2251/01;
(Continued)

(56) References Cited

U.S. PATENT DOCUMENTS 3,253,574 A * 5/1966 Malta ..... G10K 1/071 116/171
4,566,400 A * 1/1986 Keenan ..... G10K 1/072 403/372
(Continued)

FOREIGN PATENT DOCUMENTS

GB 250887 4/1926
JP UMA4952875 8/1972
(Continued)

OTHER PUBLICATIONS

European Search Report (EESR) dated May 12, 2020 for Japanese Application No. 17867671.4-1011 /3537427 with translation, 8 pages.
(Continued)

*Primary Examiner* — Kareen K Thomas
(74) *Attorney, Agent, or Firm* — David L. Hoffman; Nolan Heimann LLP

(57) ABSTRACT

A drinking container that can be used for various applications such as toasting for producing a sound for enjoyment at table, dinning or banquet, a bell, or further, determination of a beverage poured into the drinking container is used for producing a sound for enjoyment and comprises: a container-type resonator; and a handle connected to the resonator at a position of a node of vibration during resonance of the resonator.

14 Claims, 15 Drawing Sheets

(51) Int. Cl.

| | |
|---|---|
| ***G10K 1/072*** | (2006.01) |
| ***G10K 1/00*** | (2006.01) |
| ***G10K 1/06*** | (2006.01) |
| *G10K 1/07* | (2006.01) |

(52) U.S. Cl.
CPC ..... *G10K 1/00* (2013.01); *G10K 1/06* (2013.01); *G10K 1/072* (2013.01); *A47G 2019/2244* (2013.01); *A47G 2200/143* (2013.01); *B65D 2203/12* (2013.01); *G10K 1/07* (2013.01)

(58) Field of Classification Search
CPC B65D 85/72; B65D 2203/12; A47G 19/2227; A47G 19/22; A47G 2019/2244; A47G 2200/143; G10K 1/00; G10K 1/06; G10K 1/072; G10K 1/07; G10K 1/10
See application file for complete search history.

(56) References Cited

U.S. PATENT DOCUMENTS

| | | | | |
|---|---|---|---|---|
| 5,235,893 | A * | 8/1993 | Malta | G10K 1/071 84/452 R |
| 6,739,282 | B1 * | 5/2004 | Yuan | G10K 1/071 116/167 |
| 8,511,493 | B2 | 8/2013 | Bernstein | |
| 8,875,922 | B2 | 11/2014 | Bernstein | |
| 2004/0244671 | A1 * | 12/2004 | Murray | G10K 1/071 116/171 |
| 2005/0211058 | A1 * | 9/2005 | Crane | G10D 13/00 84/402 |
| 2009/0235858 | A1 * | 9/2009 | Yuan | G10K 1/071 116/171 |
| 2013/0068082 | A1 * | 3/2013 | Mohr | B05D 1/18 427/367 |

FOREIGN PATENT DOCUMENTS

| | | | |
|---|---|---|---|
| JP | H0286368 | U | 7/1990 |
| JP | H0298755 | U | 8/1990 |
| JP | 2013533174 | A | 8/2013 |
| TW | 201338728 | A | 10/2013 |
| WO | WO97/35503 | | 10/1997 |

OTHER PUBLICATIONS

Pinterest, Vintage Brass Shot Glass Bell on Bottom Saluda Skoal Votre Sante Drinking Game, eBay; Apr. 28, 2020, 3 pages.

* cited by examiner

FIG. 7A
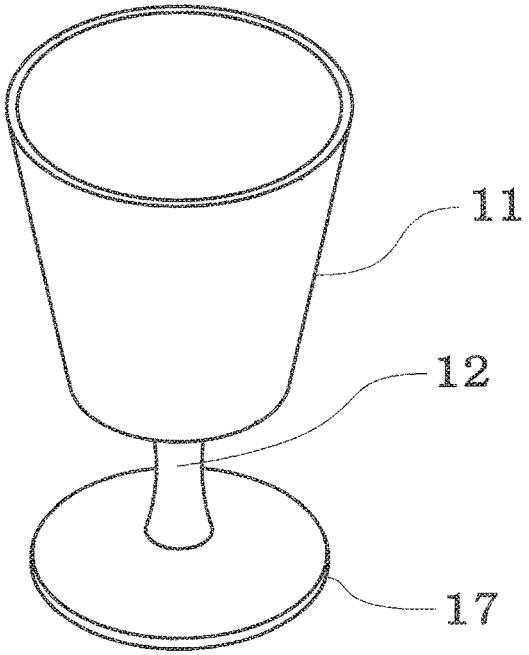
FIG. 7B
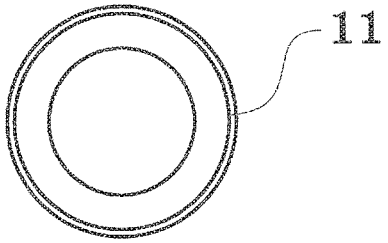
FIG. 7E
FIG. 7C
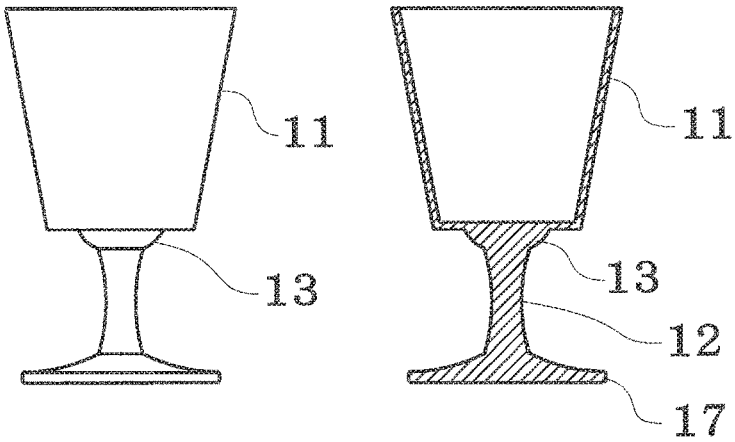
FIG. 7D
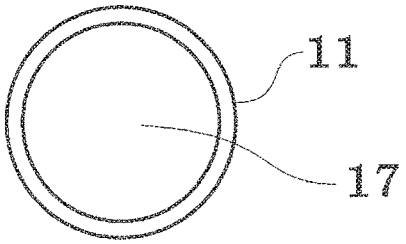

EMPTY

WATER

SODA WATER

SECTIONAL VIEW TAKEN ALONG THE LINE A-A

SECTIONAL VIEW TAKEN ALONG THE LINE B-B

SECTIONAL VIEW TAKEN ALONG THE LINE C–C

SECTIONAL VIEW TAKEN ALONG THE LINE D-D

SECTIONAL VIEW TAKEN ALONG THE LINE E–E

SECTIONAL VIEW TAKEN ALONG THE LINE F-F

DRINKING CONTAINER USED FOR TOASTING AND DRINKING CONTAINER SERVING AS BELL

CROSS REFERENCE TO RELATED APPLICATION

This application is a continuation of International Patent Application No. PCT/JP2017/039239, having an international filing date of Oct. 31, 2017, which designated the United States, the entirety of which is incorporated herein by reference. Japanese Patent Application No. 2017-025491 filed on Feb. 15, 2017 and Japanese Patent Application No. 2016-214635 filed on Nov. 1, 2016 are also incorporated herein by reference in its entirety.

TECHNICAL FIELD

The present disclosure relates to a drinking container that can be used to produce a sound for enjoyment and produces different sounds depending on types of beverages poured into the drinking container.

BACKGROUND ART

At banquet or the like, beverages are poured into glasses or the like for toasting at a start of the banquet.

For toasting using conventional glasses, people just clink the glasses with care so as not to break the glasses, and cannot enjoy producing a sound.

Japanese Patent Application Laid-Open No. 2013-533174 discloses a liquid container such that a wine bottle can be used as a wine glass, and partially refers to a liquid container made of metal. However, it is unclear what type of metal is used to fabricate the liquid container.

Also, various types of stainless tumblers are commercially available, which are not used to produce a sound for enjoyment.

The present inventor has focused on the fact that clinking stemmed glasses such as wine glasses or goblets produces a good ringing sound, and fabricated a stemmed drinking container made of brass so that a user can further enjoy the ringing sound.

Lightly hitting such a drinking container provided a comfortable tone like that of a bowl hit by a Buddhist monk when chanting a Buddhist sutra.

Pouring sake into the prototype containers and clinking the containers such as for toasting provided a sound with a long lingering sound.

However, surprisingly, pouring beer into the containers and clinking the containers provided a completely different sound.

As a container that produces a sound, for example, Japanese Utility Model Application Laid-Open No. 49-52875 discloses a glass with a call bell.

However, the glass disclosed in the document is such that the glass is simply fitted to the call bell, and not such that a container such as a glass and a resonator are integrated.

SUMMARY

An object of the disclosure is to provide a drinking container that can be used for various applications such as toasting for producing a sound for enjoyment at table, dinning or banquet, a bell, or further, determination of a beverage poured into the drinking container.

According to one aspect of the disclosure, there is provided a drinking container used for producing a sound for enjoyment, comprising: a container-type resonator; and a handle connected to the container-type resonator at a position of a node of vibration during resonance of the container-type resonator.

In the drinking container according to the disclosure, the handle may be provided on a lateral side or a lower side of the container-type resonator.

Further, in the drinking container according to the disclosure, the handle may also be a stem that makes the container-type resonator self-standing.

The drinking container according to disclosure may have any of the following features.

For example, the drinking container produces different sounds depending on amounts of a beverage poured into the container-type resonator.

The drinking container produces different sounds depending on types of beverages poured into the container-type resonator, and allows determination of a type of a beverage poured into the container-type resonator.

The drinking container can be used as a bell for producing a sound for enjoyment.

In the drinking container according to another aspect of the disclosure, at least the container-type resonator is preferably made of a Pb-free brass alloy containing 0.09% by mass or less of Pb component.

The Pb-free brass alloy preferably contains 73% to 78% by mass of Cu, 2.7% to 3.4% by mass of Si, 0.04% to 0.20% by mass of P, and the balance Zn with inevitable impurities.

The container is used for drinking, and the alloy may contain Cu with about 2% to 12% Sn added as long as the alloy does not contain harmful Pb, Cd, or the like.

Cd is preferably 10 ppm or less.

In the disclosure, a position of a node of vibration during resonance of the resonator is referred to as a so-called sweet spot, and can be easily determined by a vibration test and a vibration mode analysis.

The drinking container according to the disclosure may have various shapes such as of a glass, a goblet, a tumbler, a collins glass, a wine glass, a champagne glass, or a beer glass.

Beverages may include sake, shochu, wine, whisky, brandy, liqueur, vodka, beer, juice, milk, soda water, or water, but not limited to them.

Among the beverages, sparkling beverages cause a major change in a hitting sound.

In the drinking container according to the disclosure, the handle is provided at the node of resonance of the resonator. Thus, even if the handle is held by hand, a resonance sounds with a lingering sound.

The drinking container according to the disclosure produces a big ringing sound, and thus the users can clink the drinking containers, for example, for toasting or greeting at dining or the like for enjoyment.

The drinking container according to the disclosure produces different hitting sounds depending on types of beverages.

Thus, the drinking container is expected to be applied in a variety of fields such as production processes or sales of the beverages or situations for drinking and enjoying the beverages.

Also, the disclosure has showed that a sparkling liquid significantly limits vibration of the container.

In other words, a variety of uses of the sparkling liquid as a damper (vibration limiting device) using remarkable damping performance are possible.

It is difficult to be immediately determined from its appearance whether a transparent beverage or solution is a sparkling beverage or not. However, by simply toasting the drinking containers or the like, the type of the beverage can be determined from a sound produced by the drinking container.

This is very helpful for visually impaired persons.

For example, if the drinking container is configured to be also usable as a bell with moderate sound volume and noticeable peaks of frequency of sound caused by vibration, the drinking container can be used for distinguishing between a carbonated liquid and a non-carbonated liquid. Conveniently, the liquid can be immediately determined by hearing the sound.

BRIEF DESCRIPTION OF THE DRAWINGS

FIG. 7A is a perspective view of an example of a goblet-type resonator, FIG. 7B is a plan view, FIG. 7C is a front view, FIG. 7D is a bottom view, and FIG. 7E is a sectional view thereof.

FIG. 8A illustrates a state where the resonator is empty, FIG. 8B illustrates a state where water is poured into the resonator, and FIG. 8C illustrates a state where soda water is poured into the resonator.

DESCRIPTION OF EMBODIMENTS

Figure 1:
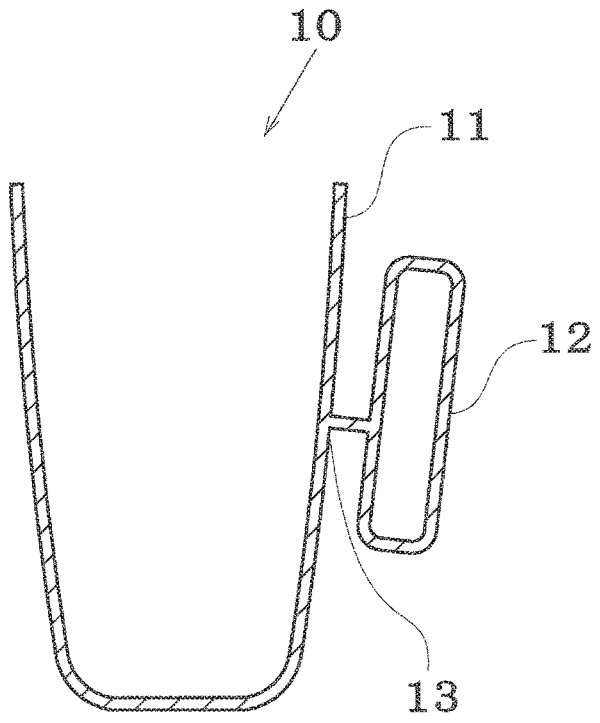
FIG. 1 illustrates an example of a glass-type drinking container.

The following disclosure provides many different embodiments, or examples, for implementing different features of the provided subject matter. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected of coupled to each other with one or more other intervening elements in between.

Now, embodiments of a drinking container according to the disclosure will be described with reference to the drawings.

FIG. 1 illustrates a glass-shaped drinking container 10.

FIG. 1 is a sectional view thereof.

The drinking container 10 includes a handle 12 connected at a position of a node of vibration (sweet spot) 13 on a lateral side of a body as a resonator 11.

The sweet spot 13 is often located on a lateral side or a bottom of a container, and in FIG. 1, the handle 12 is provided at the sweet spot 13 near a vertical center on the lateral side.

Figure 2:
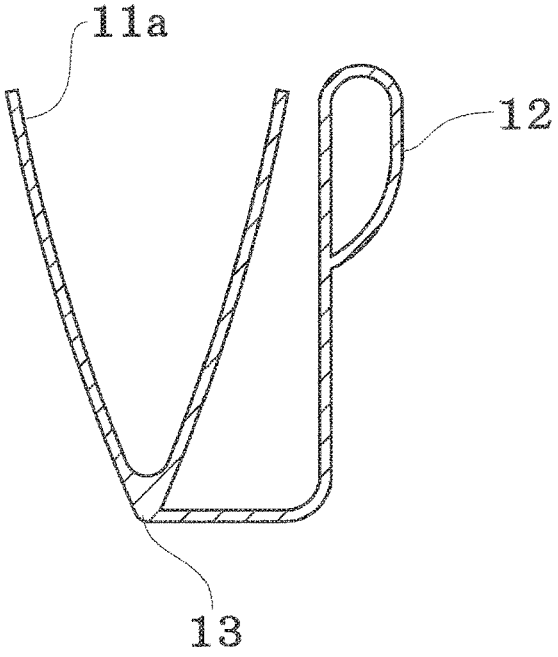
FIG. 2 illustrates an example of a drinking container with a handle formed at a bottom of a resonator.

FIG. 2 illustrates an example in which a sweet spot 13 as a node of resonance of a resonator 11*a* is formed at a bottom, and a handle 12 is formed at the bottom.

The handle may be provided on an outer peripheral side of the resonator 11*a* like a cup. In this case, the handle can be easily held because it is like a handle of a cup.

The resonator 11*a* is formed in a conical shape, and thus has the sweet spot at the bottom.

Figure 3:
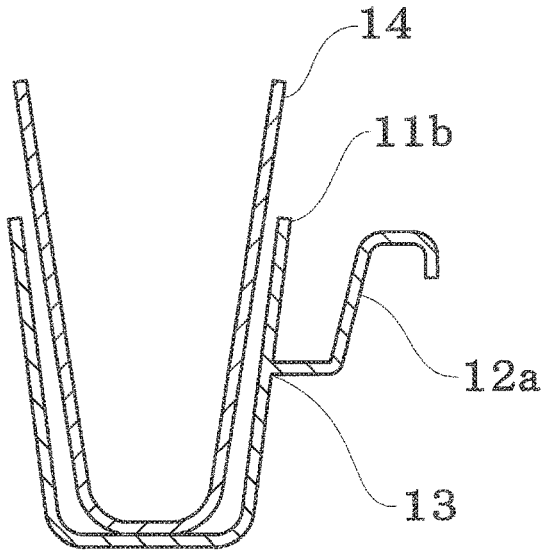
FIG. 3 illustrates an example of a container with a glass provided inside a container portion constituted by a resonator.

FIG. 3 illustrates an example in which a handle 12*a* is formed at a sweet spot 13 on a lateral side of a resonator 11*b*, and a glass 14 into which a beverage is poured is formed inside the resonator 11*b*.

Figure 4A:
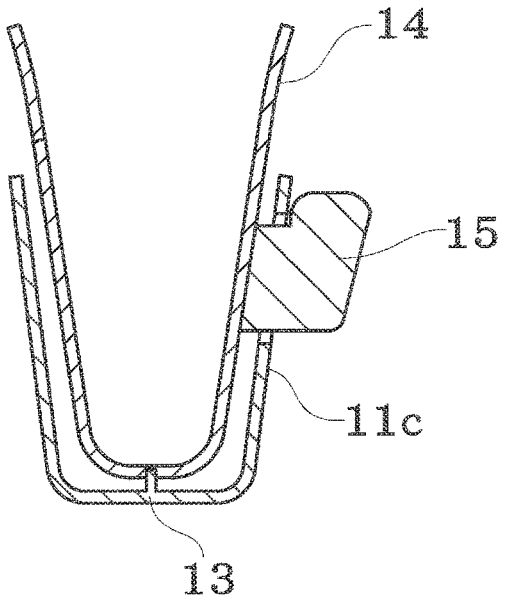
FIG. 4A is a vertical sectional view of an example of a container with a handle formed on a glass provided inside of a resonator.
Figure 4B:
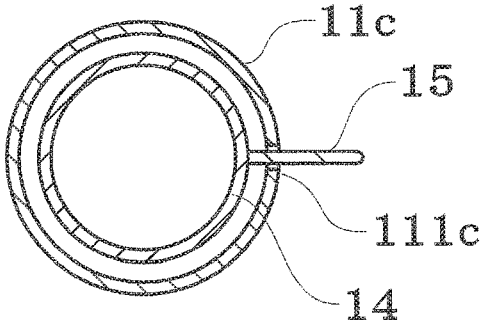
FIG. 4B is a cross sectional view thereof.

FIGS. 4A and 4B show an example in which a glass 14 is mounted inside a resonator 11*c*, and a slit 11*c* is formed in a lateral side of the resonator 11*c* so that a handle 15 of the glass 14 protrudes through the slit 11*c*.

FIG. 4A is a vertical sectional view and FIG. 4B is a cross sectional view.

Thus, even if the handle 15 is held with the glass containing a beverage, the glass is connected to a sweet spot 13 on a body as the resonator, and lightly hitting the resonator produces a ringing sound.

Figure 5A:
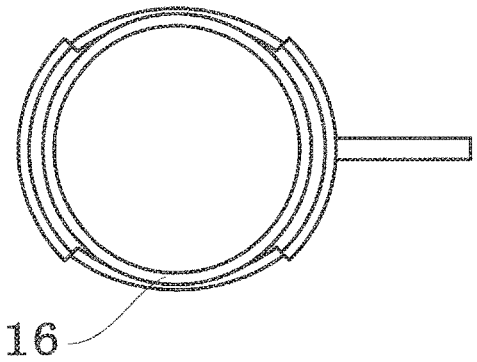
FIG. 5A is a plan view of an example of a container configured so that a user can easily put his/her mouth on a glass provided inside a resonator.
Figure 5B:
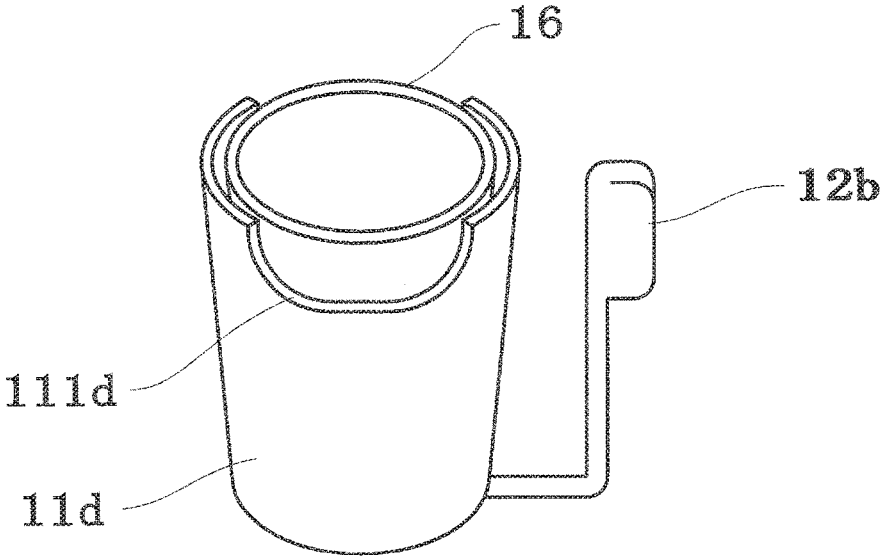
FIG. 5B is a perspective view.
Figure 5C:
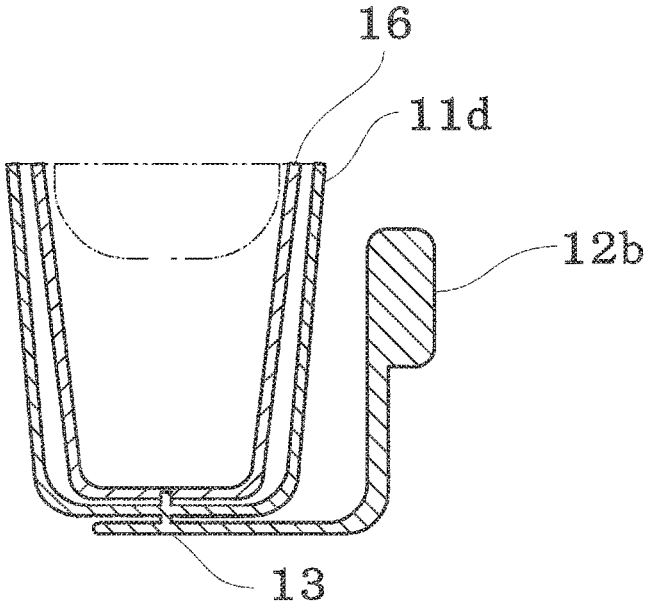
FIG. 5C is a sectional view thereof.

FIGS. 5A to 5C illustrate an example in which a handle 12*b* is formed at a bottom of a resonator 11*d*, and notches 111*d* are formed in opposite lateral sides so that a user can easily put his/her mouth on a glass 16 inside the resonator 11*d*.

FIG. 5A is a plan view, FIG. 5B is a perspective view of an appearance, and FIG. 5C is a sectional view.

Figure 6A:
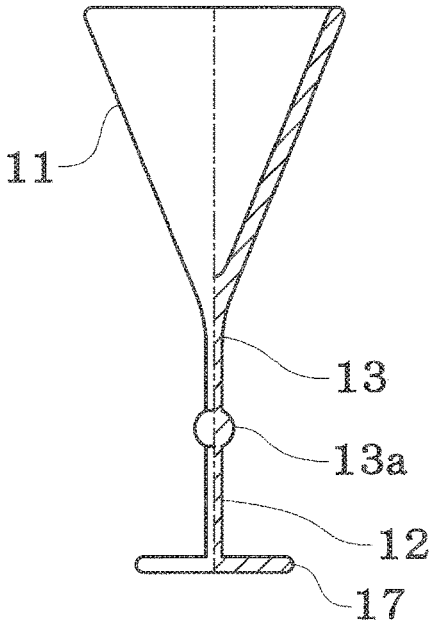
FIGS. 6A to 6D illustrate examples of drinking containers that also serve as container-type bells, which are rotationally symmetric with respect to a center line.

FIG. 6A illustrates an example in which a handle 12 is provided on a lower side of a resonator 11 constituted by a cocktail glass-type container.

In this embodiment, a drinking container also serves as a bell.

In this embodiment, the handle 12 serves as a stem having a circular foot 17 that allows the drinking container self-standing.

The drinking container includes a node 13 that is a node of vibration during resonance when the resonator 11 is lightly hit to produce a sound.

In this embodiment, a node 13*a* having an increased diameter portion is further formed in a middle of the bar-like handle so as to prevent an influence on resonance when the handle is held by hand.

Figure 6B:
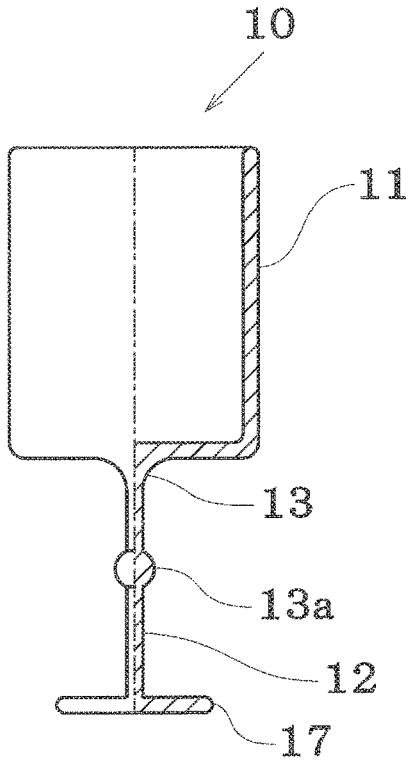

FIG. 6B illustrates an example in which a handle 12 as a stem is formed on a lower side of a glass-type resonator 11.

Also in this case, a node of vibration 13 is located at a connection between a bottom and the stem of the resonator, and a node of vibration 13*a* involving vibration of the stem is provided as an increased diameter portion in a middle of the stem.

Figure 6C:
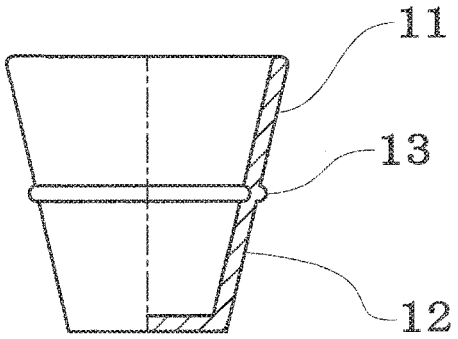

FIG. 6C illustrates an example in which a node 13 constituted by a ring-like ridge is formed on a lateral side of a tumbler-type resonator 11.

In this case, a lower side of the node 13 is a handle 12.

Figure 6D:
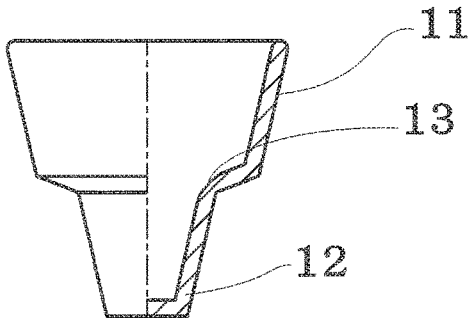

FIG. 6D illustrates an example of a resonator 11 with a varying inner diameter thereof in which a node 13 is located at a portion having varied inner diameter on a lateral side of a resonator 11.

FIGS. 7A-7E illustrate an example of a goblet-type resonator in which a handle 12 as a stem and a foot 17 are formed at a lower side of a node 13 located at a bottom of a tumbler-type resonator 11.

This resonator is made of a brass alloy.

Figure 8A:
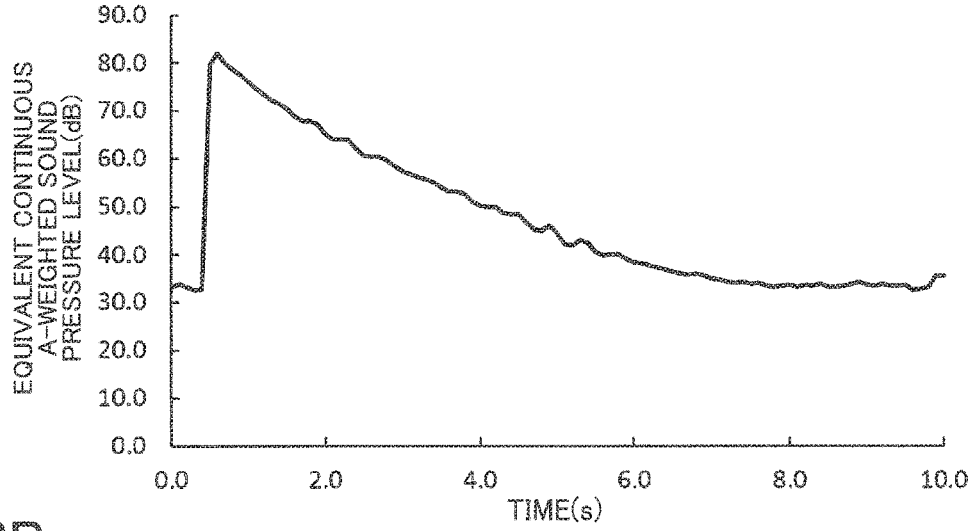
FIGS. 8A to 8C are graphs illustrating types of beverages poured and changes in sound.
Figure 8B:
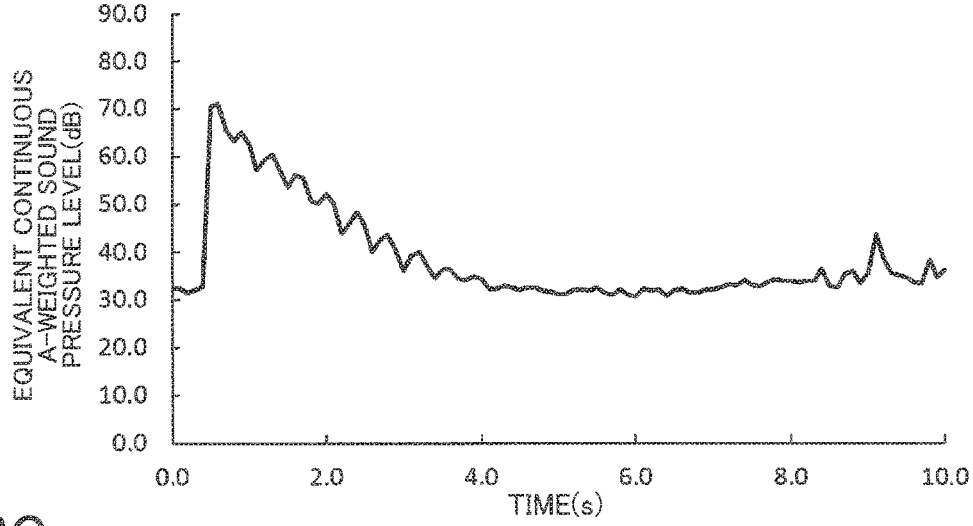
Figure 8C:
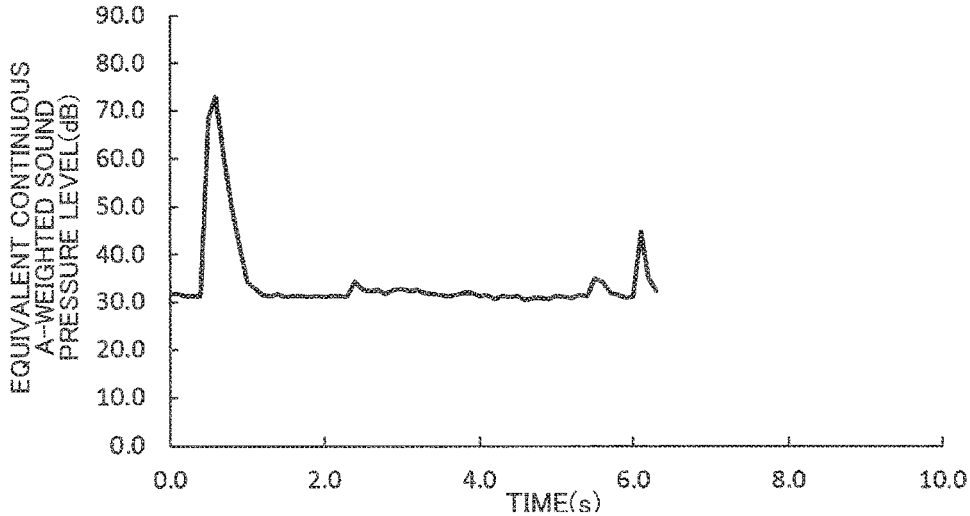

FIGS. 8A to 8C illustrate results of measurement of changes in produced sound performed using a bell-type drinking container including the resonator 11 in FIG. 7 with an outer diameter of an opening of about 40 mm, a thickness of 1 mm, a height of the resonator of about 45 mm, an inner diameter of the bottom of the resonator of about 20 mm, a height of the handle 12 of about 25 mm, and an outer diameter of the foot 17 of 35 mm.

FIG. 8A to 8C are graphs of results of measurement at a distance of about 1 m from the container using an integral-mode precision sound level meter 2236 (manufactured by Brüel & Kjær, Japan) when the resonator is hit so that a maximum value of a A-weighted sound pressure level of a hitting sound is 80±5 dB. FIG. 8A illustrates a state where the resonator is empty, FIG. 8B illustrates a state where water is poured into the resonator up to about a half level, and FIG. 8C illustrates a state where soda water is similarly poured into the resonator up to about a half level.

Figure 18:
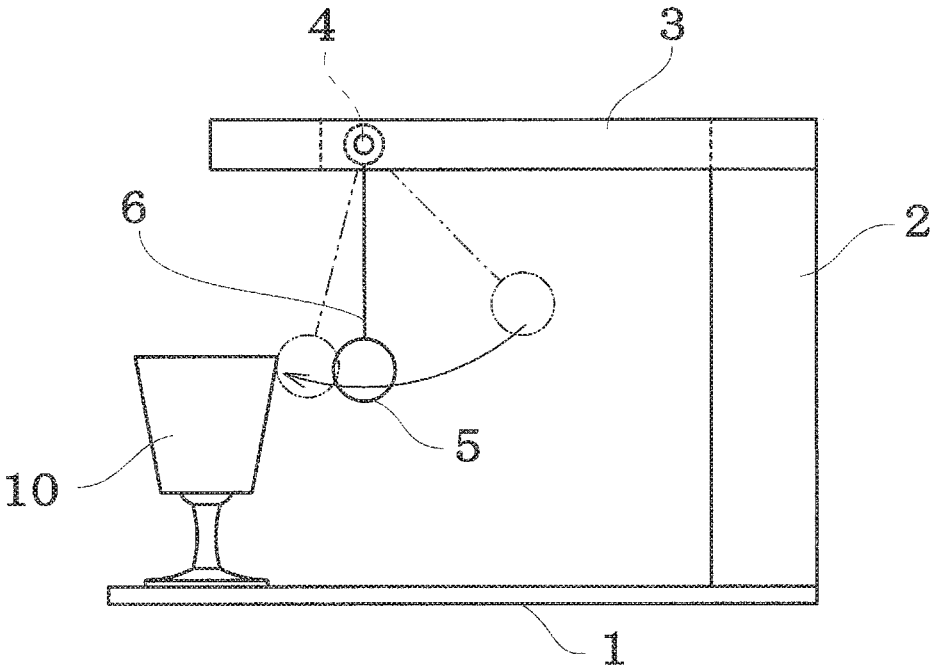
FIG. 18 illustrates a device for measuring a produced sound.

FIG. 18 illustrates a device used for the measurement.

The device forms a U-shape and includes an arm 3 provided via a post 2 from a base 1 on which a drinking container 10 to be measured is placed.

A hitting ball 5 was suspended by a suspending shaft 6 from a rotatable rotor 4 mounted to the arm 3.

The hitting ball 5 was rotated to be raised to a horizontal level and dropped to hit a body of the drinking container 10.

The hitting ball 5 had a diameter of 15 mm and was made of ebony.

A radius of rotation of the hitting ball is 90 mm.

It was revealed that a tone and a time of a lingering sound distinctly differed depending on types of beverages.

Measuring a time of a lingering sound with an equivalent continuous A-weighted sound pressure level decreasing from 70 dB to 50 dB, the time of the lingering sound was 2.7 seconds when the resonator was empty and 1.5 seconds when water was poured into the resonator, while the time of the lingering sound was 0.1 seconds and extremely short when soda water was poured into the resonator.

Pouring sake into the resonator and hitting the resonator showed a value close to that of the water. Thus, the drinking container 10 was able to be used as a bell and also used for toasting.

Figure 9:
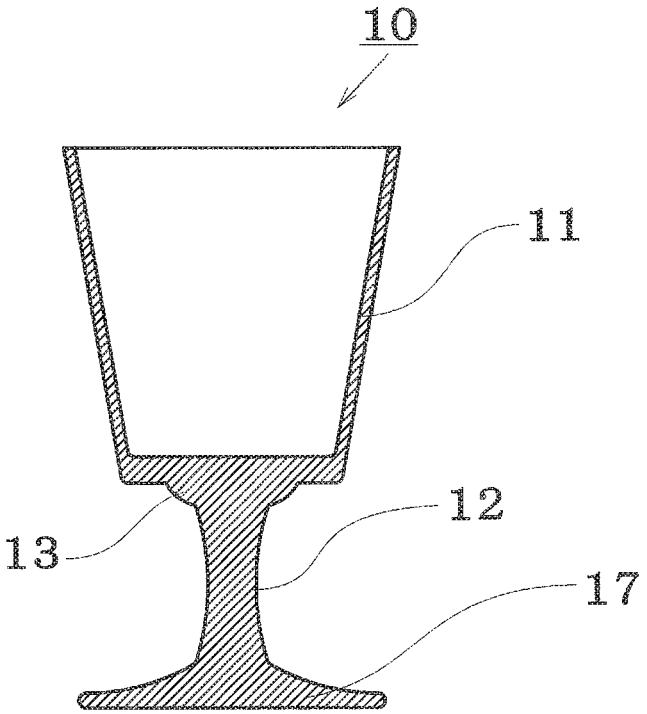
FIG. 9 illustrates an exemplary structure of a drinking container of which frequency of a hitting sound is measured.

FIG. 9 shows a beverage container 10 fabricated by casting a raw material of a brass alloy containing 75.5% by mass of Cu, 3.0% by mass of Si, 0.1% by mass of P, 0.09% by mass or less of Pb, and the balance substantially Zn and cutting the material for making the container.

FIG. 9 is a vertical sectional view of the drinking container 10 rotationally symmetric with respect to a center line.

Thus, a cross section of each part has a ring or circular shape.

On a bottom of a resonator 11 that is a body having an open top and a truncated conical outline, a handle (stem) 12 is provided and a foot 17 is provided under the handle 12.

In this embodiment, the container-like resonator (body) 11 into which a beverage is poured has an outline of an opening of about 40 mm, a depth of about 35 mm, an outline of a truncated portion of about 36 mm, a length (height) of the stem 12 from a bottom of the foot 17 of about 25 mm.

A side wall of the body has a thickness of about 1 to 1.5 mm and an outline of the stem 12 of 5 to 8 mm.

Figure 10A:
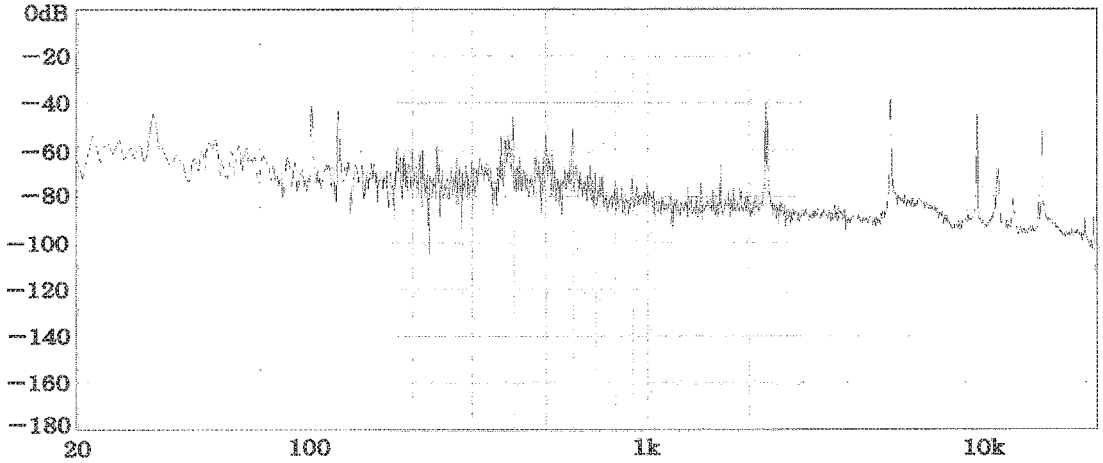
FIG. 10A is a chart of measured frequency of a hitting sound when the drinking container is empty.
Figure 10B:
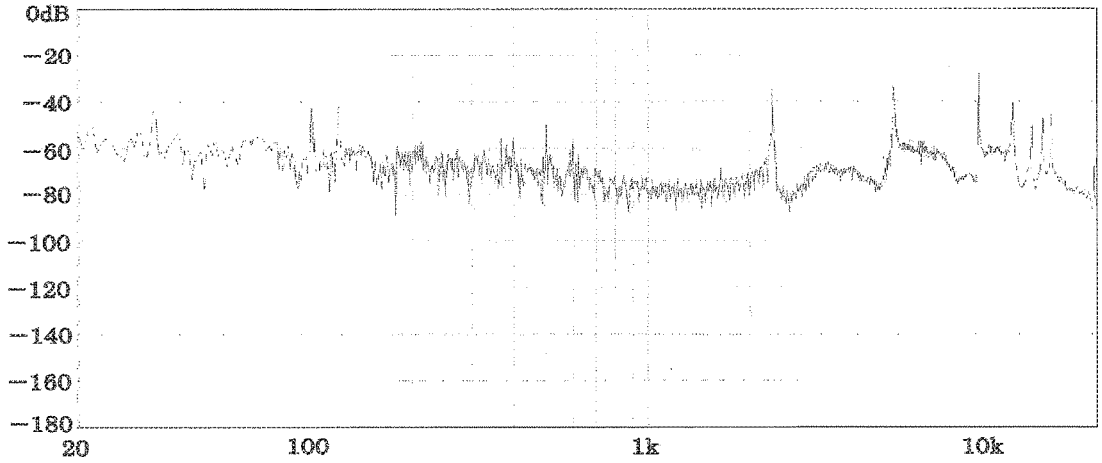
FIG. 10B is a chart of measured frequency of a hitting sound when a beverage is poured into the drinking container up to about 70%.
Figure 11A:
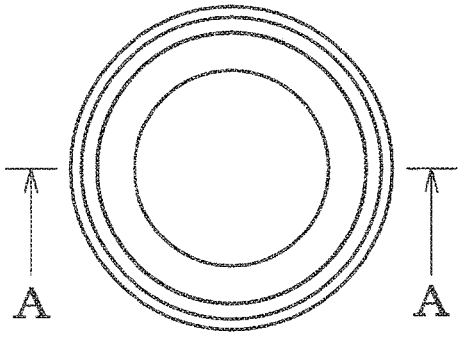
FIG. 11A is a plan view of an example of a drinking container with a groove formed inside.
Figure 11B:
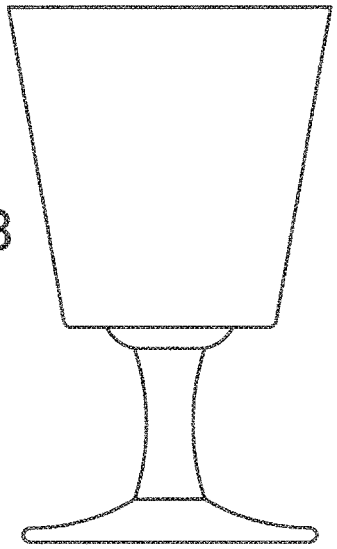
FIG. 11B is a side view.
Figure 11D:
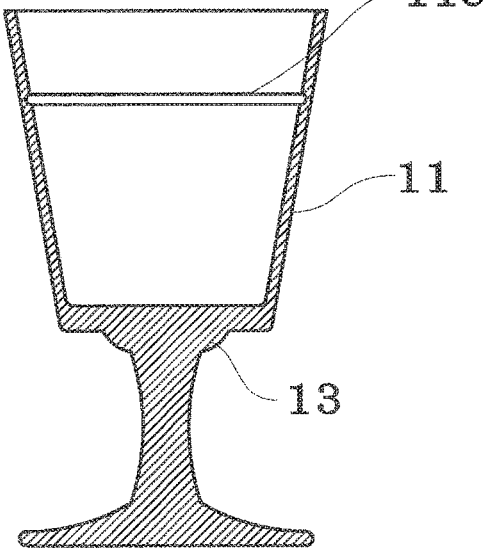
FIG. 11D is a sectional view thereof taken along the line A-A.
Figure 11C:
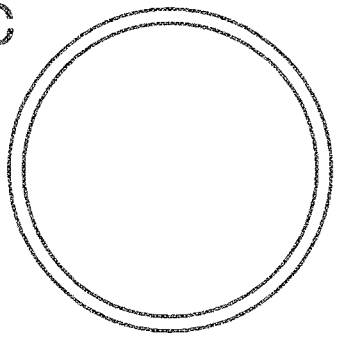
FIG. 11C is a bottom view.
Figure 12A:
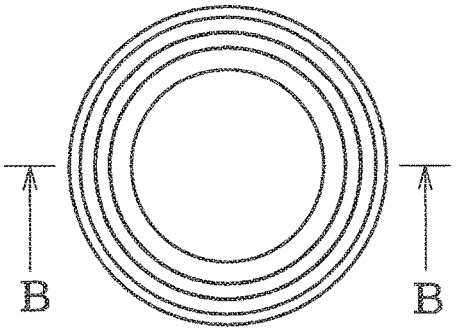
FIGS. 12A to 12D illustrate an example of a drinking container with two grooves formed inside and correspond to FIGS. 11A to 11D.
Figure 12B:
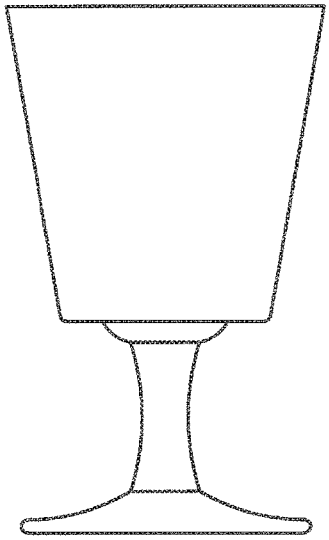
Figure 12D:
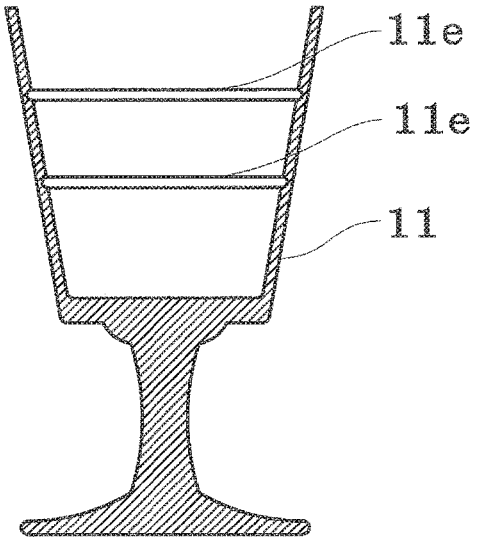
Figure 12C:
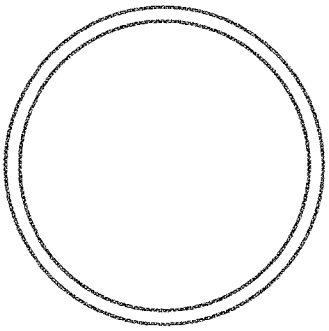

FIG. 10A is a chart of frequency of a sound produced by hitting the empty drinking containers 10 each other, and FIG. 10B is a chart of frequency of a sound produced by hitting the drinking containers 10 each other into which water is poured up to about 70%.

In the charts, the horizontal axis represents frequency and the vertical axis represents intensity of sound (dB).

The sound heard mainly had three peaks of frequency at 2,350 Hz, 5,437 Hz, and 9,703 Hz. The empty containers and the containers into which water was poured up to about 70% produced different tones of sound, but did not show large differences in peak positions.

The experiment results in FIGS. 8 and 10 show the following.

With the stem as the handle provided on the lower side of the resonator constituted by the container-type body, simply lightly hitting the body produces a big sound. Thus, the resonator is useful for a bell or a container for toasting.

In that case, for a non-carbonated or non-sparkling beverage such as water or sake, a sound with a long lingering sound is produced.

Comparing a state where such a beverage is poured into the container up to about 50% to 70% with an empty state, a time of a lingering sound is long and ½ or more of that in the empty state.

On the other hand, for a carbonated or sparkling beverage such as soda water or beer, a time of a lingering sound is very short and 1/20 or less of that in the empty state.

Particularly, if the body of the container is made of a brass alloy, a clear tone with long lingering sound is produced.

This provides a container for toasting such that when the container into which a non-carbonated beverage is poured up to about 50% is hit so that a maximum value of a A-weighted sound pressure level is 80±5 dB, a lingering sound time with the sound pressure level decreasing from 70 dB to 50 dB is one second or more.

FIGS. 11 to 17 show different embodiments.

FIGS. 11A to 17A are plan views, FIGS. 11B to 17B are front views, FIGS. 11C to 17C are bottom views, and FIGS. 11D to 17D are sectional views.

FIGS. 11 A to 11D illustrate an example in which a ring-like groove 11*e* is formed along an inner peripheral surface of a resonator 11.

Reducing a thickness of this part facilitates vibration of an upper part. A sectional shape of the groove may include a semi-circular shape, a V-notch shape, or a squared U-shape, but not limited to them.

FIGS. 12A to 12D illustrate an example in which two ring-like grooves 11*e*, 11*e* are formed along an inner peripheral surface. The number of the grooves is not limited.

Figure 13A:
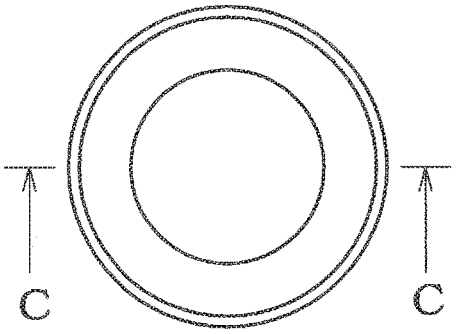
FIGS. 13A to 13D illustrate an example of a drinking container with one ridge formed outside and correspond to FIGS. 11A to 11D.
Figure 13D:
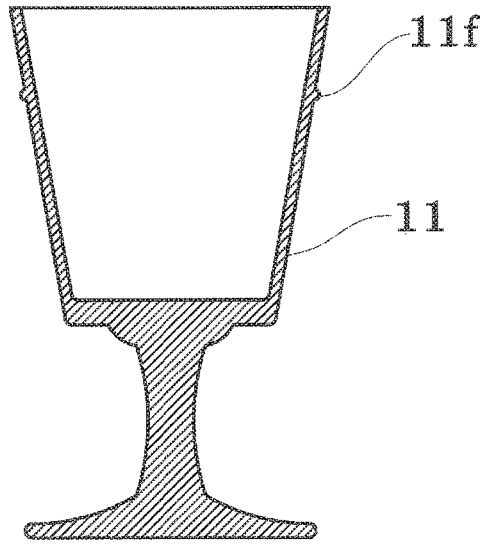
Figure 13B:
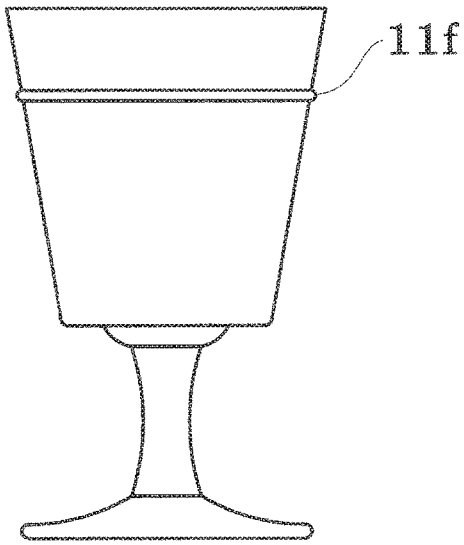
Figure 13C:
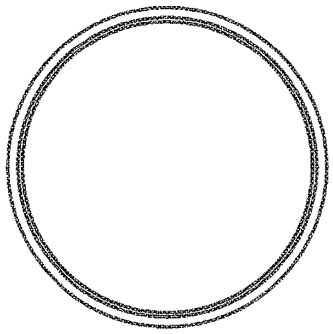
Figure 14A:
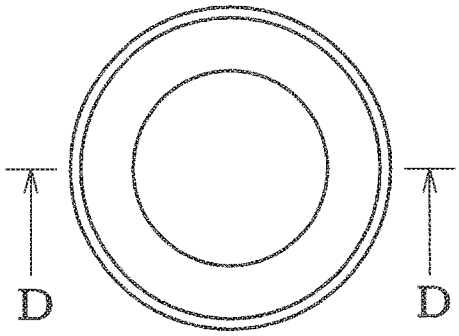
FIGS. 14A to 14D illustrate an example of a drinking container with two ridges formed outside and correspond to FIGS. 11A to 11D.
Figure 14B:
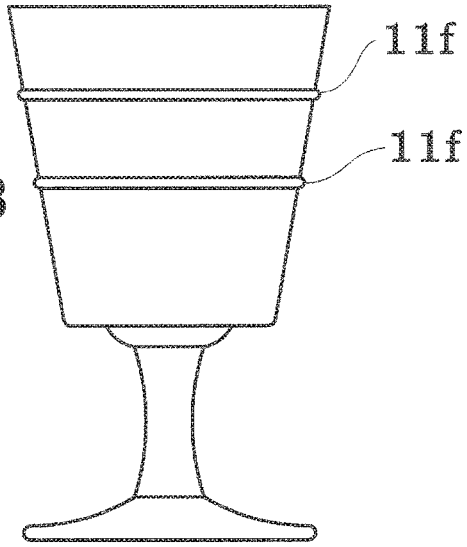
Figure 14D:
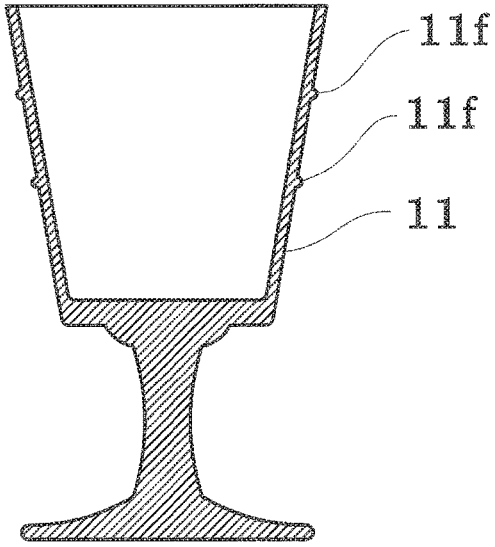
Figure 14C:
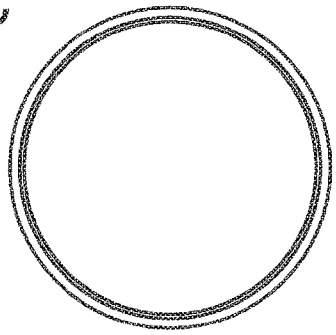
Figure 15A:
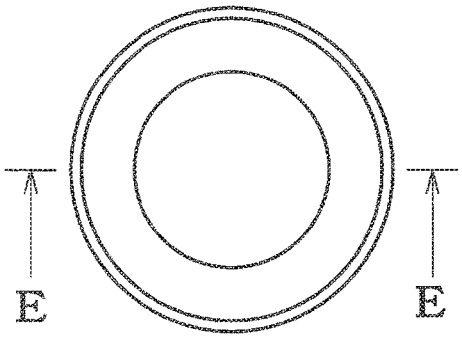
FIGS. 15A to 15D illustrate an example of a drinking container with one groove formed outside and correspond to FIGS. 11A to 11D.
Figure 15D:
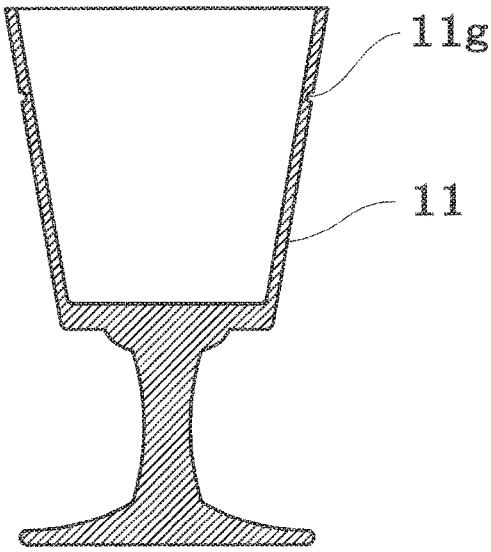
Figure 15B:
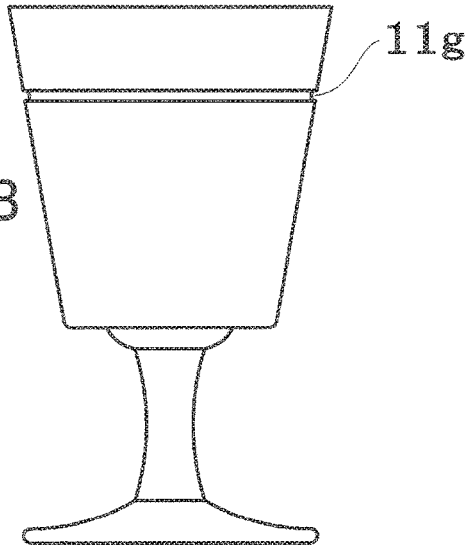
Figure 15C:
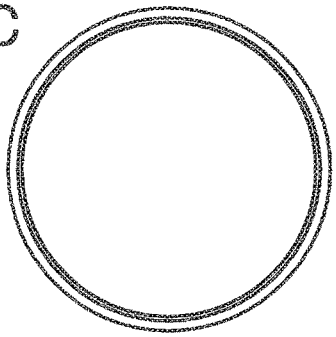
Figure 16A:
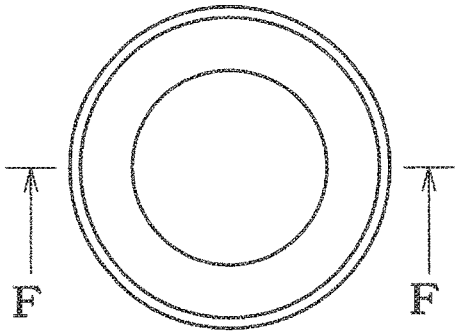
FIGS. 16A to 16D illustrate an example of a drinking container with two grooves formed outside and correspond to FIGS. 11A to 11D.
Figure 16B:
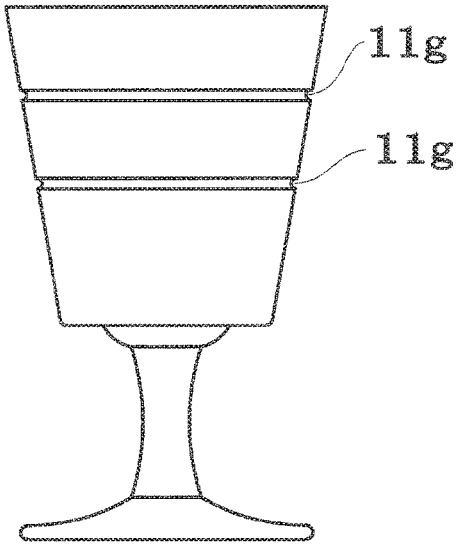
Figure 16D:
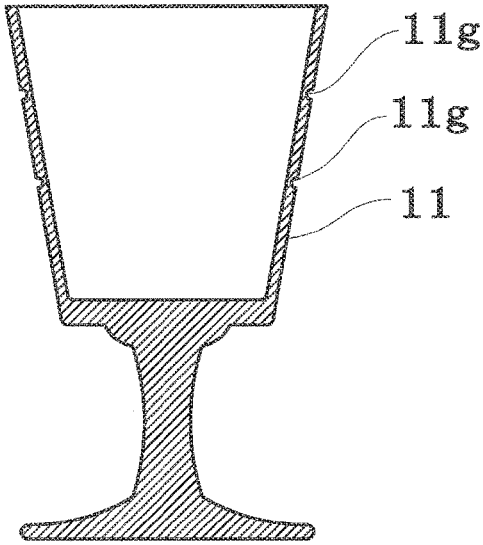
Figure 16C:
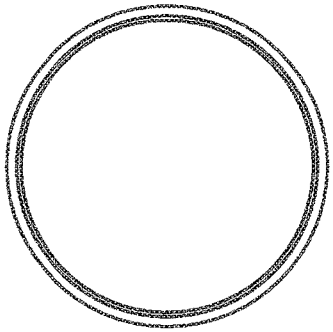

FIG. 13S A to 13D illustrate an example in which a ridge 11*f* is formed along an outer peripheral portion, and FIGS. 14 A to 14D illustrate an example in which two ridges 11*f* are formed along an outer peripheral portion.

FIGS. 15 A to 15D illustrate an example in which a ring-like groove 11*g* is formed along an outer peripheral portion, and FIGS. 16 A to 16D illustrate an example in which two ring-like grooves 11*g* are formed along an outer peripheral portion.

Figure 17:
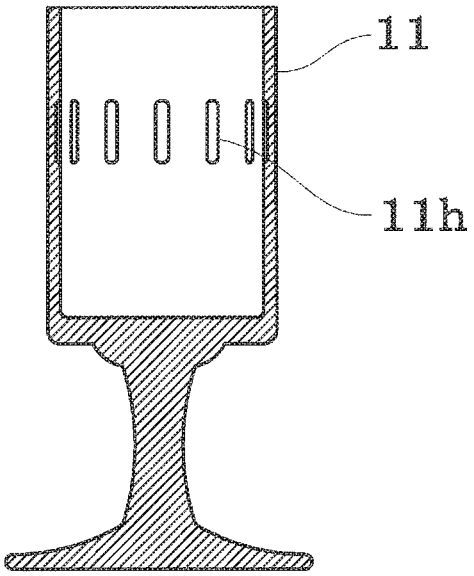
FIG. 17 illustrates an example of a drinking container with vertical grooves formed inside.

FIG. 17 illustrates an example in which vertical grooves 11*h* are formed in a body.

INDUSTRIAL APPLICABILITY

The drinking container according to the disclosure includes the handle connected to the node of vibration, and thus simply lightly hitting the drinking container produces a big sound.

Thus, the drinking container can be used for toasting for enjoying the sound, and can be also used as a bell.

Also, the drinking container produces different sounds depending on types of beverages or amounts of a beverage poured into the drinking container, and thus can be used for determination of a beverage.

What is claimed is:

1. A drinking container used for producing a sound for enjoyment, comprising a container, the container having:

a portion of adapted to form a resonator;

a handle provided at a position of a node of vibration during resonance of the resonator, and a base for self-standing the container with an opening of the container facing upwardly.

2. The drinking container according to claim 1, wherein the handle is provided on a lateral side or a lower side of the resonator.

3. The drinking container according to claim 1, wherein the handle is a stem that connects the resonator and the base.

4. The drinking container according to claim 1, wherein the drinking container produces different sounds depending on amounts of a beverage poured into the resonator.

5. The drinking container according to claim 1, wherein the drinking container produces different sounds depending on types of beverages poured into the resonator, and allows determination of a type of a beverage poured into the resonator.

6. The drinking container according to claim 1, wherein the drinking container can be used as a bell for producing a sound for enjoyment.

7. A drinking container used for producing a sound for enjoyment, comprising a container, the container having a portion adapted to form a resonator; and a handle provided at a position of a node of vibration during resonance of the resonator, wherein the resonator is made of a Pb-free brass alloy containing 0.09% by mass or less of Pb component.

8. The drinking container according to claim 7, wherein the Pb-free brass alloy contains 73% to 78% by mass of Cu, 2.7% to 3.4% by mass of Si, 0.04% to 0.20% by mass of P, and the balance Zn with inevitable impurities.

9. The drinking container according to claim 7, wherein the container includes a base for self-standing the container with an opening of the container facing upwardly.

10. The drinking container according to claim 7, wherein the handle is provided on a lateral side or a lower side of the resonator.

11. The drinking container according to claim 7, wherein the handle is a stem that connects the resonator and the base.

12. The drinking container according to claim 7 wherein the drinking container produces different sounds depending on amounts of a beverage poured into the resonator.

13. The drinking container according to claim 7, wherein the drinking container produces different sounds depending on types of beverages poured into the resonator, and allows determination of a type of a beverage poured into the resonator.

14. The drinking container according to claim 7, wherein the drinking container can be used as a bell for producing a sound for enjoyment.

* * * * *